US006526660B1

(12) United States Patent
MacNeil

(10) Patent No.: US 6,526,660 B1
(45) Date of Patent: Mar. 4, 2003

(54) DEVICE FOR TRIMMING AND SHAPING A BEARD OR MOUSTACHE

(76) Inventor: Stephen MacNeil, 36A Hester Street, Dartmouth, Nova Scotia (CA), B3A 1K2

( * ) Notice: Subject to any disclaimer, the term of this patent is extended or adjusted under 35 U.S.C. 154(b) by 119 days.

(21) Appl. No.: 09/607,946

(22) Filed: Jun. 30, 2000

(30) Foreign Application Priority Data

Jul. 2, 1999 (CA) ..... 2276882

(51) Int. Cl.[7] ..... B26B 21/14
(52) U.S. Cl. ..... 30/61; 30/50
(58) Field of Search ..... 30/50, 57, 61, 30/41.8

(56) References Cited

U.S. PATENT DOCUMENTS

| | | | | | |
|---|---|---|---|---|---|
| 1,139,056 | A | * | 5/1915 | Myatt | 30/57 X |
| 2,108,758 | A | | 2/1938 | Thompson et al. | 30/51 |
| 2,335,547 | A | * | 11/1943 | Smith | 30/50 |
| 2,534,490 | A | | 12/1950 | Weeks | 30/51 |
| 2,709,851 | A | * | 9/1955 | Randol | 30/57 |
| 3,080,651 | A | * | 3/1963 | Cas | 30/61 X |
| 3,593,416 | A | | 7/1971 | Edson | 30/50 |
| 3,938,247 | A | * | 2/1976 | Carbonell et al. | 30/50 X |
| 3,950,849 | A | * | 4/1976 | Perry | 30/50 X |
| 4,403,414 | A | | 9/1983 | Kiraly et al. | 30/57 |
| 4,693,003 | A | | 9/1987 | Ferraro | 30/50 |
| 4,785,534 | A | * | 11/1988 | Lazarchik | 30/50 |
| 5,522,137 | A | | 6/1996 | Andrews | 30/50 |
| 5,687,485 | A | | 11/1997 | Shurtleff et al. | 30/526 |
| 6,161,288 | A | * | 12/2000 | Andrews | 30/50 |
| 6,182,366 | B1 | * | 2/2001 | Richard | 30/50 |
| 6,223,442 | B1 | * | 5/2001 | Pina | 30/50 X |
| 6,311,400 | B1 | * | 11/2001 | Hawes et al. | 350/50 X |

* cited by examiner

*Primary Examiner*—Charles Goodman
(74) *Attorney, Agent, or Firm*—Sughrue Mion, PLLC

(57) ABSTRACT

A device for trimming and shaping a moustache or beard has a handle having a shaving head with a blade assembly mounted on one end. The blade assembly carries one or more blades and is movable relative tot he handle so that in a first position the blade assembly is generally parallel to the handle, in a second position the blade assembly is generally perpendicular to the handle, and in an intermediate third position the blade assembly is mounted at an angle corresponding to a conventional shaving angle. A guide member for facilitating fine motor control when using the device may be mounted on either side of the shaving head to occupy a vertical position in which the guide member extends vertically from the top of the head or a lateral position in which the guide member extends laterally of the head.

20 Claims, 3 Drawing Sheets

DEVICE FOR TRIMMING AND SHAPING A BEARD OR MOUSTACHE

BACKGROUND OF THE INVENTION

The present invention relates to a device for trimming and shaping a beard or moustache and in particular to such a device having a razor blade assembly capable of assuming different positions to accommodate the needs of the user.

DESCRIPTION OF THE PRIOR ART

Numerous devices for trimming facial hair are known in the prior art. For example, U.S. Pat. No. 5,687,485 granted to Shurtleff et al. on Nov. 18, 1997 discloses a razor which has a handle ending in a bifurcated yoke on which a blade carrier is pivotally mounted to follow the contour of the surface being shaved. Although the pivotal mounting permits the blade to follow the contour of the surface being shaved, there may not be the range of options for handling the razor desirable during trimming and shaping of a beard or moustache.

In another example, U.S. Pat. No. 5,787,594 granted to Estrada on Apr. 22, 1997 discloses a razor attached to a handle such that it is able to pivot freely about an axis. Although the pivoting blade offers greater flexibility to the user, it does not provide the degree of control desirable for all types of trimming, particularly precision trimming of a beard or moustache.

SUMMARY OF THE INVENTION

Accordingly, it is an object of the present invention to provide a device for trimming and shaping a beard or moustache which offers the user options in orienting the razor on the handle while providing for increased control over the razor in use.

According to one aspect of the present invention, there is provided a device for trimming and shaping a beard or moustache, comprising:

a handle having a longitudinal axis;

a shaving head comprising a blade assembly, said blade assembly having a shaving surface with one or more blades projecting therefrom; and an interlocking structure for affixing said shaving head to an upper end of said handle;

wherein said interlocking structure is capable of providing movement of said shaving head from a first to a third position, said first position having an orientation in which said shaving surface is substantially perpendicular to the longitudinal axis of said handle, a second position having an orientation in which said shaving surface is substantially parallel to the longitudinal axis of said handle, and said third position having an orientation in which said shaving surface is at an acute angle to the longitudinal axis of said handle.

BRIEF DESCRIPTION OF THE DRAWINGS

The present invention will be further described by way of example with reference to the drawings in which.

Similar reference numerals denote similar elements in the different figures.

DETAILED DESCRIPTION OF THE PREFERRED EMBODIMENTS

Figure 1:
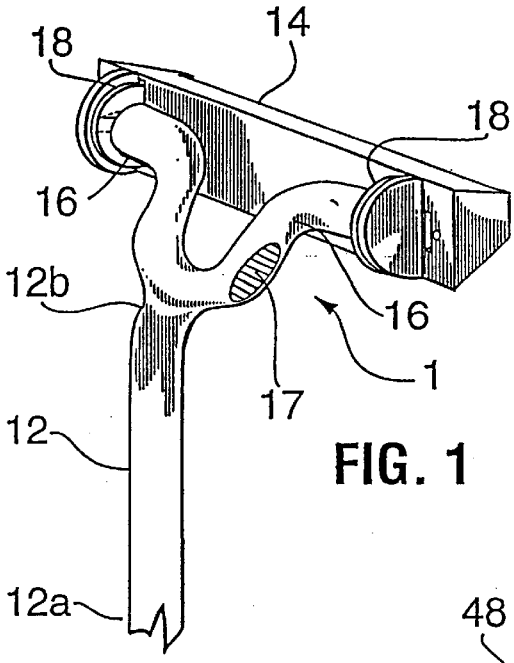
FIG. 1 is a perspective rear view of the device of the present invention according to a first embodiment.
Figure 2:
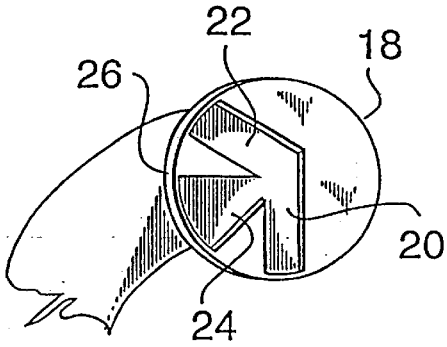
FIG. 2 is a perspective view, on an enlarged scale, of a portion of the handle of the device of FIG. 1.

With reference to FIGS. 1 and 2, according to an embodiment of the present invention, a device 10 for trimming and shaping a beard or moustache has a handle 12 having a longitudinal axis, and onto the proximal end thereof is mounted a shaving head 14 carrying a razor blade assembly 15. The handle 12 comprises a generally straight gripping portion 12*a* which bends somewhat at an upper portion 12*b*, which in turn bifurcates into two arms 16 bearing non-slip areas 17, resulting in a generally Y-shaped top portion of the handle.

The arms 16 terminate in oppositely facing disc-shaped portions 18 provided with three generally trapezoidal shaped shallow recessed areas 20, 22, 24. The recessed areas 20, 22, 24 are arranged around the periphery of each disc-shaped portion 18 with a first area 20 and a second area 22 of equal size and a third area 24 located between the first two areas 20, 22 having a larger radial width.

The circumferential edge 26 of the disc-shaped portion 18 is raised relative to the recessed areas 20, 22, 24 So as to define a wall at the outside edge of each of the recessed areas 20, 22, 24.

Figure 3:
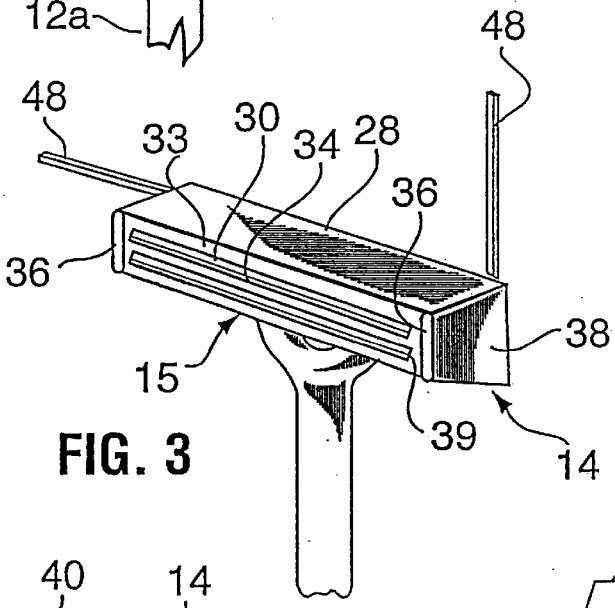
FIG. 3 is a perspective front view of the device of FIG. 1.

With reference to FIG. 3, the shaving head 14 comprises a housing 28 containing at least one blade 30. A shaving surface 33 of the housing 28 exposes a cutting edge 34 of at least one blade 30 so as to permit shaving or trimming. When the head 14 comprises more than one blade, the blades are arranged parallel to one another. Guards 36 in the form of protrusions extend forwardly from the ends 38 of the shaving head 14 to limit the cutting action of the blade(s) 30 and thus, prevent accidents.

Figure 5:
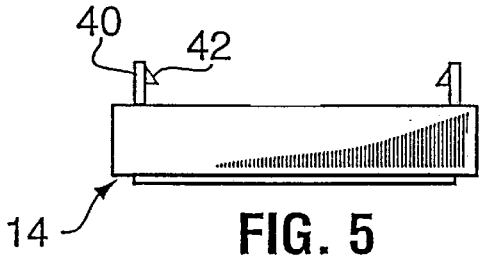
FIG. 5 is a plan view of the razor blade assembly of FIG. 4.
Figure 6:
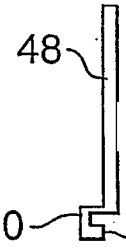
FIG. 6 is a side view of a guide member for use with the device of FIG. 1.
Figure 4:
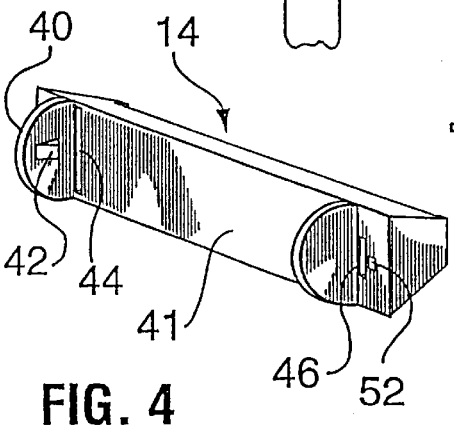
FIG. 4 is a perspective back view of a razor blade assembly of the device of FIG. 1.

Referring to FIGS. 4, 5 and 6, a pair of spaced ears 40 extend rearwardly from the back 41 of the head 14 and have lugs 42 facing each other and spaced from the back 41 of the head 14. The lugs 42 are shaped to correspond with the first and second recessed areas 20, 22 in each disc-shaped portion 18 and may be received by any one of the three corresponding recessed areas 20, 22, 24 as detailed below. Located between the ears 40 are a pair of slots 44, one slot 44 adjacent each ear 40. The slots 44 are proportioned to receive the circumferential edge 26 of the disc-shaped portion 18. At least one hole 46 (and preferably two, one near each end 38 of the housing 28), is provided on the back 41 of the head 14 for use with a guide member 48. The guide member 48 is provided with a J-shaped attachment portion 50 for securing the guide member 48 in a hole 46 in a removable manner. The back 41 of the head 14 is provided with a raised stop 52 for use with the guide member 48 as detailed below.

Figure 7:
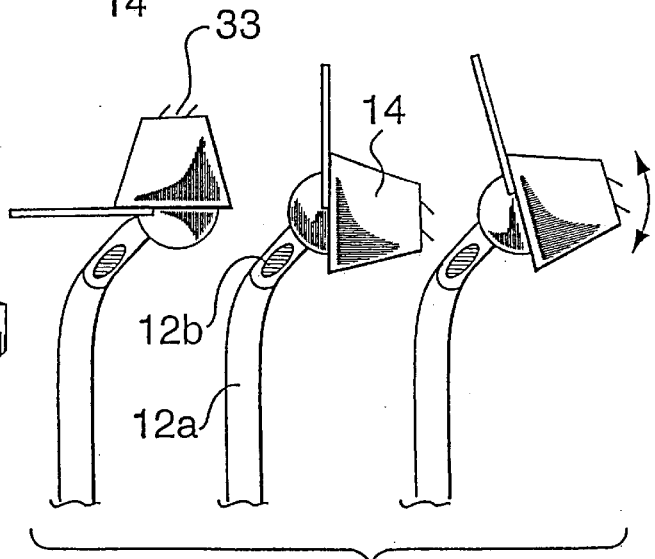
FIG. 7 shows diagrammatically the available different positions of the blade assembly with the guide member attached thereto.

In operation of the device, the arms 16 of the handle 12 are squeezed towards each other, making use of the non-slip areas 17, so that the distance between the disc-shaped portions 18 becomes less than the distance between ears 40 of the shaving head 14, whereby each lug 42 may be positioned over one of a selected matching pair of the recessed areas 20, 22, 24 on corresponding disc-shaped portions 18 of the arms 16. Upon release of the pressure on the arms 16, each one of the selected matching pair of recessed areas 20, 22, 24 receives a corresponding lug 42 securing the head 14 onto the handle 12. The lugs 42 cooperate to each engage respective first, second or third recessed areas 20, 22, 24 and hold the shaving head 14 in a corresponding first, second or third position. As seen in FIG. 7 (from left to right), in the first position, the head 14 is oriented such that the shaving surface 33 is generally perpendicular to the straight portion 12*a*, or longitudinal axis of the handle 12. In the second position, the head 14 is oriented such that the shaving surface 33 is generally parallel to the straight portion 12*a*, or longitudinal axis of the handle 12. In the third position, the head 14 is held in an intermediate position which corresponds substantially with a conventional angle of the shaving surface 33 as used in known shavers. The head 14 is fixed in either the first or second positions, but is capable of a rocking or pivoting movement in the third position, facilitated by the greater radial width of the recessed area 24. In any of these positions, the circumferential edge 26 of each disc-shaped portion 18 is received in a slot 44, which increases the stability of the engagement in the first and second positions and guides the rocking movement of the head 14 in the third position.

The shaving head 14 may be removed from the handle 12 by squeezing the arms 16 of the handle 12, thereby disengaging the lugs 42 from corresponding recessed areas 20, 22 or 24, permitting the head 14 to be separated from the handle 12.

Referring to FIGS. 3, 4 and 6, the guide member 48 may be removably attached by inserting the tip 54 of the J-shaped attachment portion 50 into a hole 46. This permits the guide member 48 to be swivelled between a position extending vertically from the top of the housing 28 of the head 14 through an approximately 90 degree arc to a lateral position extending away from the head 14 and parallel to the blade or blades 30 of the blade assembly 15. The stop 52 prevents swivel movement of the guide member 48 beyond this range.

In use the user can select any of the three positions of the head 14 relative to the handle 12 to suit the trimming or shaving task at hand. For a task requiring fine trimming movement, the guide member 48 may be attached permitting the user to hold the handle 12 in one hand and align the guide member 48 with the area to be trimmed, thereby increasing control over the device 10 during a shaving operation.

With the guide member 48 in the vertical position, it is preferably precisely aligned in parallel with ends 39 of the blades 30 and perpendicular to the blades 30 for facilitating trimming accuracy. With the guide member 48 in the lateral position the guide member 48 is preferably precisely aligned and parallel with a single blade 30 or the central blade of three. With a dual blade system, the guide member 48 should preferably be aligned with the most central of the two blades 30 in a blade assembly 15.

The guide member 48 may also be affixed to the side or top of the shaving head 14 and, if desired, two guide members 48 can be provided (as shown in FIG. 3) and independently positioned in vertical and/or lateral positions.

The shaving head 14 with blade assembly 15 can be of regular size, as shown, or in a mini-trim version, in which the length of the shaving head 14 and blade assembly 15 are reduced, but the spacing of the ears 40 remains the same, to accommodate the mini blade assembly between the arms 16 of the handle 12. In effect, the end portions of the shaving head 14 outside the ears 40 are omitted in the mini-trim version and the guide member 48 is either attached by other means or not used. The mini-trim shaving head and a regular size shaving head can be interchanged, as desired, to undertake different precision aspects, or otherwise, of a shaving operation.

While the device of the invention is primarily intended for trimming or shaping a moustache or beard, it is also useful for other shaving activities, such as trimming side burns, bikini lines, underarms or legs. When used by a female for these purposes, the mini-trim version of the device is particularly applicable.

With reference to FIGS. 8 to 14, a second embodiment of the present invention will now be described.

The second embodiment is similar to the first embodiment and only those aspects which differ from the first embodiment are now described.

Figure 8:
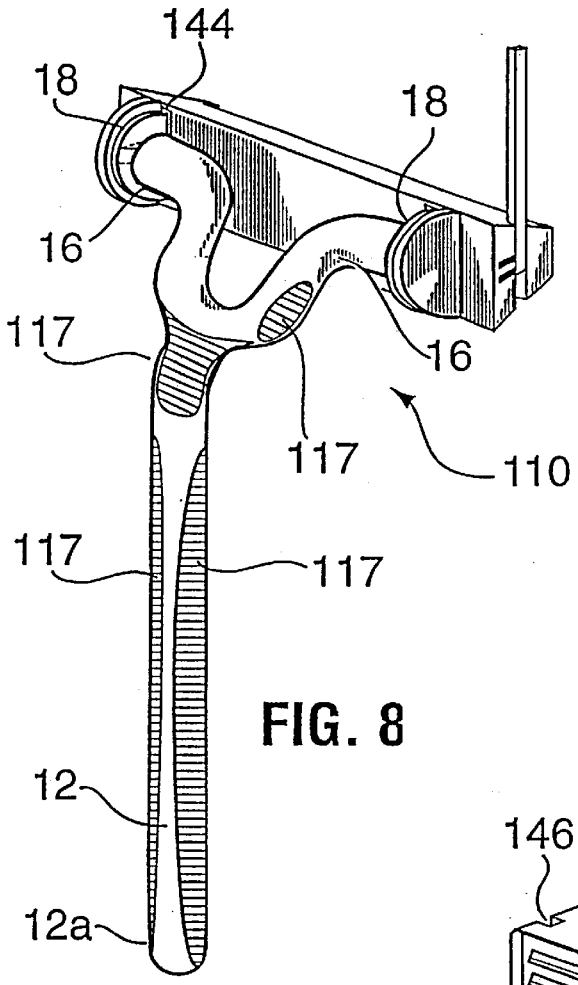
FIG. 8 is a perspective rear view of the device of the present invention according to a second embodiment.

As illustrated in FIG. 8, the handle 12 is covered with a non-slip material 117 to provide the user with a better grip. The non-slip material 117 may cover certain regions of the handle 12, as illustrated in FIG. 8, or alternatively, the handle 12 may be completely covered with the non-slip material 117.

Figure 12:
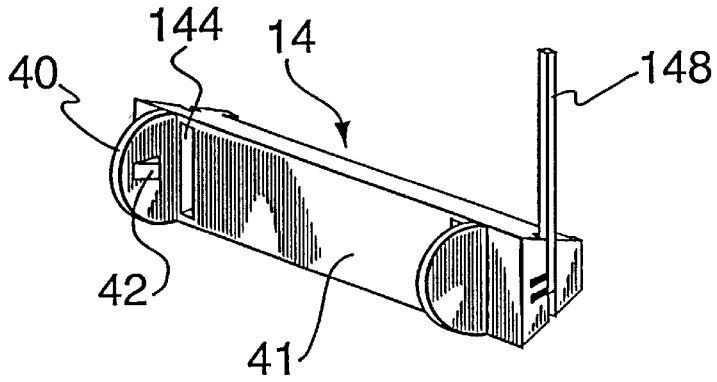
FIG. 12 is a perspective back view of a razor blade assembly of the device of FIG. 8.
Figure 13:
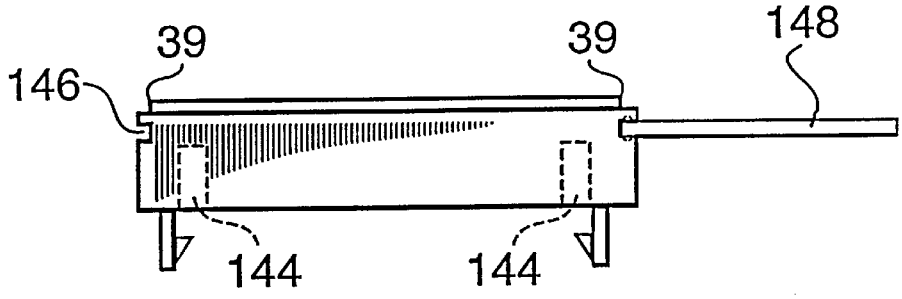
FIG. 13 is a plan view of the razor blade assembly of the device of FIG. 12.

In the present embodiment, as seen in FIGS. 12 and 13, slots 144 of the shaving head 14 are wider than slots 44 of the first embodiment. Slots 144 are sufficiently wide enough to enable disc-shaped portions 18 be inserted directly into the slots 144 without interference from the lugs 42. This enables the user to easily attach and remove the shaving head 14 to and from the handle 12. Such slots 144 are present in both the regular size or in the mini-trim versions and the ease of removal and attachment enables the user to conveniently change the shaving head 14 from a regular size head to a mini-trim head or vice versa, as desired.

To attach the shaving head 14, the user squeezes the arms 16 of the handle 12 together and seats the shaving head 14 onto the disc-shaped portions 18. A portion of the periphery of each disc-shaped portion 18 is inserted into a corresponding slot 144 and lugs 42 are in registry with a selected pair of the recessed areas 20, 22 24. The arms 16 are sufficiently resilient such that upon release of the arms 16 by the user, they return to their original position thus engaging the lugs 42 in the selected recesses.

Figure 9:
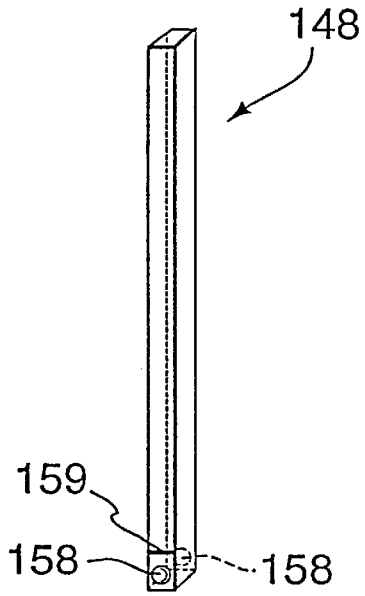
FIG. 9 is a perspective view of a guide member in accordance with the second embodiment.

A guide member 148 is illustrated in FIG. 9 and is provided with bosses 158 near the end of the guide member 148. Alignment marks 159 are provided on of the guide member 148 near the bosses for use as described below.

Figure 10:
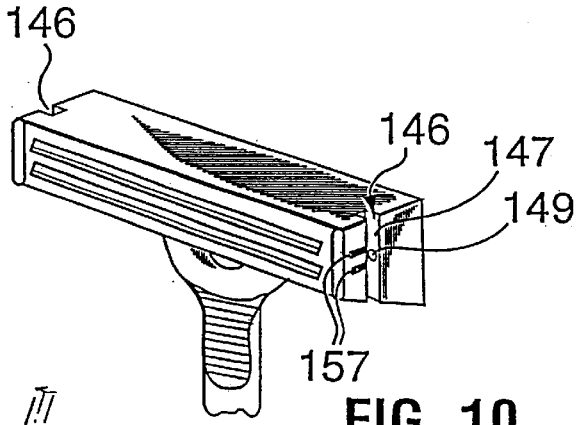
FIG. 10 is a perspective front view of the device of FIG. 8.

Referring to FIG. 10, instead of holes 46 of the first embodiment, the present embodiment provides grooves 146 in the ends 38 of the shaving head 14. The grooves 146 extend from one side of the shaving head 14 to an opposite side of the shaving head 14 such that the grooves 146 are substantially aligned in parallel with the shaving surface 33.

Figure 11:
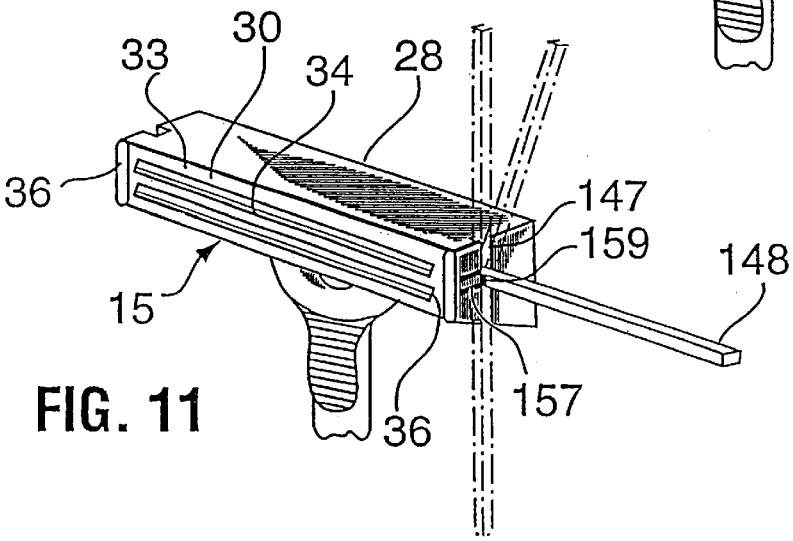
FIG. 11 is a perspective front view of the device of FIG. 8 with the guide member attached.

The sides 147 of a central portion of grooves 146 are provided with holes 149 for receiving bosses 158. The holes 149 are aligned with the top most blade of the shaving head 14. The guide member 148 is snapped into position with bosses 158 fitting into corresponding holes 149. The guide member 148 should be dimensioned so that the fit of the guide member 148 into the groove 146 is snug and the guide member 148 is held in place by the cooperation of bosses 158 and holes 149. As illustrated in FIG. 11, the bosses 158 and holes 149 are arranged so that the guide member 148 can swivel from a first vertical position, in which the guide member 148 is positioned above the shaving head 14, through an intermediate horizontal position, to a second vertical position, in which the guide member 148 is positioned below the shaving head 14, and is substantially parallel to a longitudinal axis of the handle 12. Thus, according to this embodiment, the guide member 148 is permanently affixed to either side 38 of the shaving head 14. When not in use, the guide member 148 can be swivelled to the second vertical position instead of detached from the shaving head 14, as described in the first embodiment.

Horizontal alignment indicators 157 are provided on a portion of the side 38 of the shaving head 14 as illustrated in FIGS. 10 and 11. When the guide member 148 is inserted or pivoted into the horizontal position, alignment mark 159 is visible and located between indicators 157 thus providing visual confirmation that the guide member 148 is in a horizontal position.

Since holes 149 are aligned with the top most blade of the shaving head 14, when the guide member 148 is in the horizontal position, guide member 148 is aligned with the top most blade of the shaving head 14, thus providing the user with greater control and accuracy when shaving (see FIGS. 11 and 13).

In the up vertical position or the down vertical position, the innermost side of the guide member is aligned with the outermost edge 39 of the at least one razor blade to similarly provide the user with greater control and accuracy when shaving. The dimensions of the guide member 148 are such that when it is in a vertical position, the guide member 148 is flush with the side 38 of the shaving head 14 (see FIG. 12).

The device 110 can be used with the guide member 148 on either side of the shaving head 14. Housings for both the mini-trim and regular size versions of the shaving head 14 have the same grooves 146 and related attachment features for securing the guide member 148 to the shaving head 14.

The guide member 148 may be any length but when placed in the vertical position so as to extend above the shaving head 14, the guide member 148 should preferably protrude at least 2 cm above the shaving head 14. Preferably the guide member 148 is made of plastic and the user can cut it to a desired length.

Figure 14:
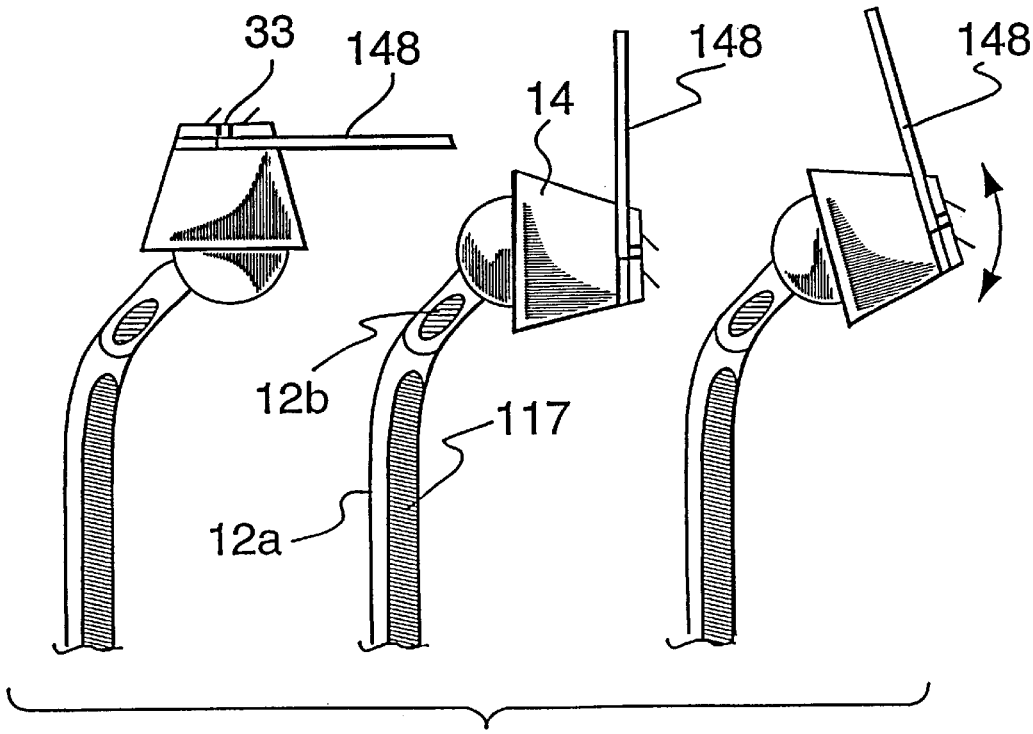
FIG. 14 is a shows diagrammatically the available different positions of the blade assembly with the guide member attached thereto.

FIG. 14 illustrates sample configurations of the second embodiment with the shaving head in first, second and third positions (from left to right) with the guide member 148 attached. In the first position, the guide member 148 is in a vertical position extending below the shaving head 14. In the second position, the guide member 148 is in a vertical position extending above the shaving head 14. In the third position, the guide member 148 is in a vertical position extending above the shaving head 14. Of course other configurations of the guide member 148 are possible for each of the three positions.

I claim:

1. A device for trimming and shaping a beard or moustache, comprising:

a handle having a longitudinal axis;

a shaving head comprising a blade assembly, said blade assembly having a shaving surface with one or more blades projecting therefrom;

an interlocking structure for affixing said shaving head to an upper end of said handle;

wherein said interlocking structure is capable of providing movement of said shaving head from a first to a third position, said first position having an orientation in which said shaving surface is substantially perpendicular to the longitudinal axis of said handle, a second position having an orientation in which said shaving surface is substantially parallel to the longitudinal axis of said handle, and said third position having an orientation in which said shaving surface is at an acute angle to the longitudinal axis of said handle; and at least one guide member removably attached to said shaving head and capable of being swiveled in a 90° arc from a first position, substantially parallel to the longitudinal axis of said handle and extending above the upper end of said handle, to a second position substantially perpendicular to the longitudinal axis of said handle and extending obliquely to said handle.

2. The device according to claim 1, wherein said shaving head is essentially fixed when in said first or second position, but is capable of slight pivotal motion when in said third position.

3. The device according to claim 1, wherein said third position permits orientation of said shaving head at an angle that facilitates shaving by a user.

4. The device according to claim 1, wherein said guide member in the first position is preferably aligned in parallel with an end of said blade of said blade assembly, and said guide member in the second position is preferably aligned in parallel with a most central blade of said blade assembly.

5. The device according to claim 1, wherein said guide member extends at least 2 cm from a surface of said shaving head.

6. The device according to claim 1, wherein said handle is covered with a non-slip material.

7. A device for trimming and shaping a beard or moustache, comprising:

a handle having a logitudinal axis;

a shaving head comprising a blade assembly, said blade assembly having a shaving surface with one or more blades projecting therefrom;

an interlocking structure for affixing said shaving head to an upper end of said handle;

wherein said interlocking structure is capable of providing movement of said shaving head from a first to a third position, said first position having an orientation in which said shaving surface is substantially perpendicular to the longitudinal axis of said handle, a second position having an orientation in which said shaving surface is substantially parallel to the longitudinal axis of said handle, and said third position having an orientation in which said shaving surface is at an acute angle to the longitudinal axis of said handle; and at least one guide member permanently attached to said shaving head and capable of being swivelled from a first position, substantially parallel to the longitudinal axis of said handle and extending above the upper end of said handle, to a second position, substantially parallel to said shaving surface and perpendicular to the longitudinal axis of said handle, and to a third position substantially parallel to the longitudinal axis of said handle and extending below the upper end of said handle.

8. The device according to claim 7, wherein said guide member in the first or third positions is preferably aligned with an end of said blade of said blade assembly, and in the second position is preferably aligned in parallel with a top most blade of said shaving assembly.

9. The device according to claim 7, wherein said guide member extends at least 2 cm from a surface of said shaving head.

10. The device according to claim 7, wherein said handle is covered with a non-slip material.

11. A device for trimming and shaping a beard or moustache, comprising:

a handle having a longitudinal axis;

a shaving head comprising a blade assembly, said blade assembly having a shaving surface with one or more blades projecting therefrom;

an interlocking means for affixing said shaving head to an upper end of said handle;

wherein said interlocking means is capable of providing movement of said shaving head from a first to a third position, said first position having an orientation in which said shaving surface is substantially perpendicular to the longitudinal axis of said handle, a second position having an orientation in which said shaving surface is substantially parallel to the longitudinal axis of said handle, and said third position having an orientation in which said shaving surface is at an acute angle to the longitudinal axis of said handle; and at least one guide member removably attached to said shaving head and capable of being swiveled in a 90° arc from a first position, substantially parallel to the longitudinal axis of said handle and extending above the upper end of said handle, to a second position substantially perpendicular to the longitudinal axis of said handle and extending obliquely to said handle.

12. The device according to claim 11, wherein said shaving head is essentially fixed when in said first or second position, but is capable of slight pivotal motion when in said third position.

13. The device according to claim 11, wherein said third position permits orientation of said shaving head at an angle that facilitates shaving by a user.

14. The device according to claim 11, wherein said guide member in the first position is preferably aligned in parallel with an end of said blade of said blade assembly and said guide member in the second position is preferably aligned in parallel with a most central blade of said blade assembly.

15. The device according to claim 11, wherein said guide member extends at least 2 cm from a surface of said shaving head.

16. The device according to claim 11, wherein said handle is covered with a non-slip material.

17. A device for trimming and shaping a beard or moustache, comprising:

a handle having a longitudinal axis;

a shaving head comprising a blade assembly, said blade assembly having a shaving surface with one or more blades projecting therefrom;

an interlocking means for affixing said shaving head to an upper end of said handle;

wherein said interlocking means is capable of providing movement of said shaving head from a first to a third position, said first position having an orientation in which said shaving surface is substantially perpendicular to the longitudinal axis of said handle, a second position having an orientation in which said shaving surface is substantially parallel to the longitudinal axis of said handle, and said third position having an orientation in which said shaving surface is at an acute angle to the longitudinal axis of said handle; and at least one guide member permanently attached to said shaving head and capable of being swivelled from a first position, substantially parallel to the longitudinal axis of said handle and extending above the upper end of said handle, to a second position, substantially parallel to said shaving surface and perpendicular to the longitudinal axis of said handle, and to a third position substantially parallel to the longitudinal axis of said handle and extending below the upper end of said handle.

18. The device according to claim 17, wherein said guide member in the first or third position s is preferably aligned with an end of said blade of said blade assembly and in the second position is preferably aligned in parallel with a top most blade of said shaving assembly.

19. The device according to claim 17, wherein said guide member extends at least 2 cm from a surface of said shaving head.

20. The device according to claim 17, wherein said handle is covered with a non-slip material.

* * * * *